United States Patent [19]

Kim

[11] Patent Number: 4,854,464

[45] Date of Patent: Aug. 8, 1989

[54] PHOTOGRAPH KEEPING BOX

[75] Inventor: Hae J. Kim, Seoul, Rep. of Korea

[73] Assignee: KMB Industries, Corp., Kyunggi-Do, Rep. of Korea

[21] Appl. No.: 137,254

[22] Filed: Dec. 23, 1987

[30] Foreign Application Priority Data

Jan. 13, 1987 [KR] Rep. of Korea ..... 292/1987

[51] Int. Cl.[4] ..... B65D 1/36; B65D 25/04; B65D 85/30

[52] U.S. Cl. ..... 220/22; 206/455; 206/578

[58] Field of Search ..... 220/22; 206/316, 203, 206/454, 455, 456, 449, 578

[56] References Cited

U.S. PATENT DOCUMENTS

| | | | |
|---|---|---|---|
| 2,665,808 | 1/1954 | McAlister | 220/22 |
| 2,929,530 | 3/1960 | Sargent | 220/22 |
| 3,858,720 | 1/1975 | Floser | 206/455 |
| 4,234,089 | 11/1980 | Morris | 220/22 |
| 4,326,629 | 4/1982 | Tate | 206/203 |

*Primary Examiner*—George E. Lowrance
*Attorney, Agent, or Firm*—Angelo Notaro

[57] ABSTRACT

A box for keeping photographs comprising a hexahedral body, a lid pivotally connected to the body, and an inner case being mounted into the body, the inner case consisting of a plurality of the spaced and slightly inclined partition plates, each having at its upper side a raised portion, side plates attached to opposite sides of the partition plates, and a base plate or base plates attached to undersides of the partition plates. The box permits an easy arrangement and an easy search of the photographs.

3 Claims, 3 Drawing Sheets

PHOTOGRAPH KEEPING BOX

BACKGROUND OF THE INVENTION

The present invention relates to a box for holding or supporting photographs in a generally upright position. More particularly, this invention relates to a photograph supporting box which permits an easy arrangement of photographs and enables to easily search and take them out when necessary.

One known photograph box, as shown in FIG. 3, comprises a hexahedral body (1) composed of a thick paper and having an opened side. A lid (2) is hinged to the body (1). An inner box (7) is provided for preventing the lid (2) from laterally moving. In keeping photographs in such a box, a plurality of transparent thermoplastic film bags (8), such as vinyl film bags, each containing an index card (9) and a photograph (10) are erectly contained one by one in the inner box (7). Hence, this prior art box necessarily requires the separate inner box (7) to prevent the lid (2) from free playing or twisting in every direction in a closed position. A large number (usually 15 to 20) of the vinyl film bags (8), each containing a photograph, and a large number of the index cards (9), are required and this disadvantageously results in complications in manufacturing the box and in an increase in the manufacturing cost. Further, when a small amount of photographs are contained in the box, they often fall down therein and become disordered, resulting in difficulties in finding desired photographs. When the box is fully filled with the photographs, it becomes very inconvenient to place a removed photograph back into its original position.

SUMMARY OF THE INVENTION

In accordance with the present invention, there is provided a photograph keeping box comprising a body having a hexahedral shape, a lid pivotally connected to the body, and an inner case being mounted in the body. The inner case comprises a plurality of partition plates arranged side by side at a predetermined space and uniformly included at a predetermined angle. Since plates are attached to opposite sides of the so arranged and inclined partition plates at such a level that upper portions of the side plates and upper portions of the partition plates are somewhat exposed when the inner case is mounted in the body. A base plate or base plates are attached to under sides of the partition plates to further enhance a structural steadiness of the inner case. Each of the partition plates has, at its upper side, a raised portion which is protruded when the inner case is mounted in the body.

In one embodiment, each of the partition plates has a generally inverted U-shape with two legs and the recessed portion between them, and two base plates are attached to undersides of the legs of the plates.

BRIEF DESCRIPTION OF THE DRAWING

In the accompanying drawings, forming a part of this specification, and in which reference numerals shown in the drawings designate like or corresponding parts throughout the same.

DETAILED DESCRIPTION

Figure 1:
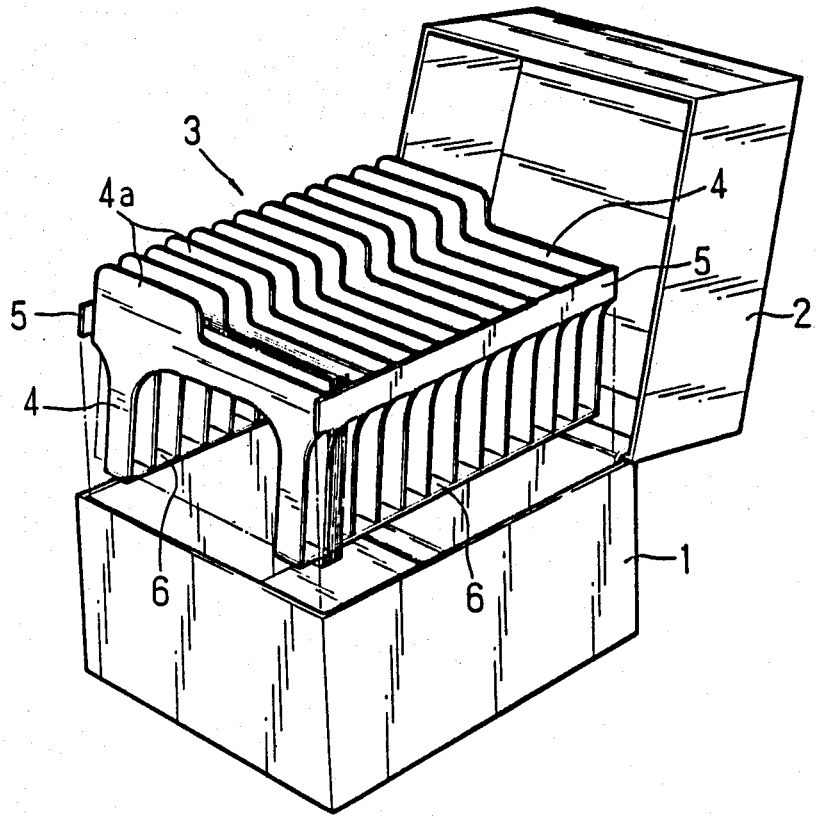
FIG. 1 is an exploded perspective view of the preferred embodiment of a photograph keeping box in accordance with the present invention.
Figure 2:
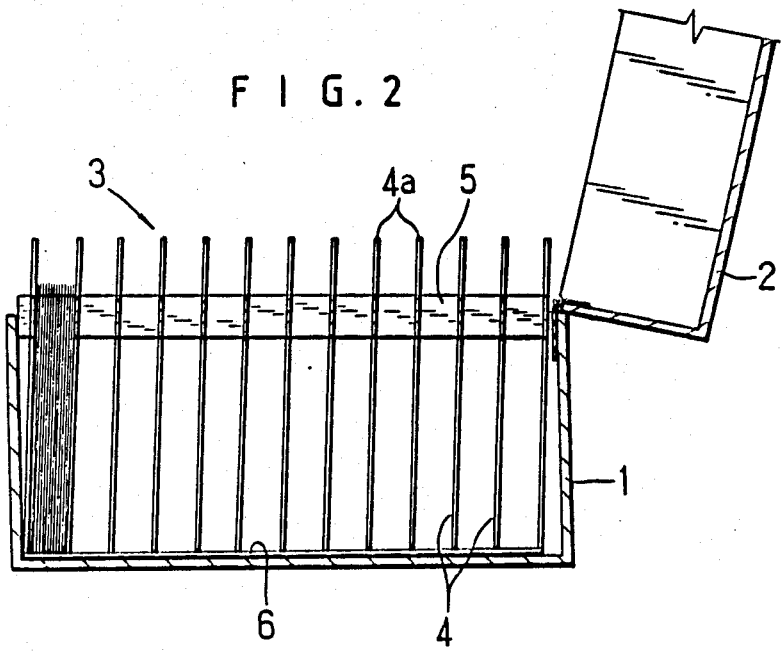
FIG. 2 is a longitudinal sectional view of the box of FIG. 1.
Figure 3:
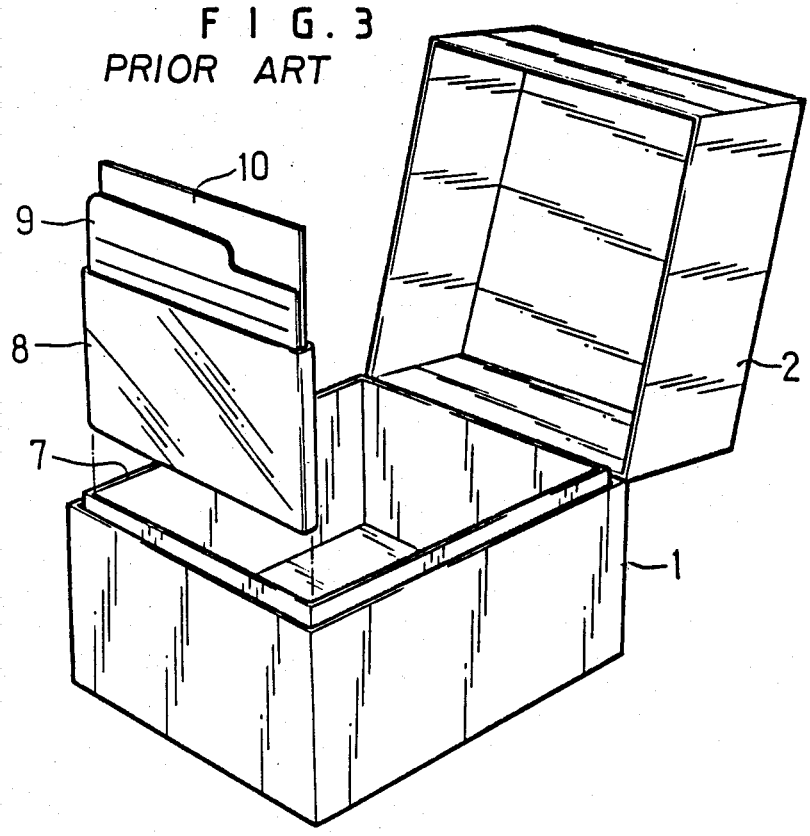
FIG. 3 PRIOR ART
FIG. 3 is an exploded perspective view of a photograph keeping box of the prior art.

Referring to FIGS. 1 and 2, there is shown a photograph keeping box according to the present invention.

The photograph keeping box comprises a hexahedral body 1 having an opened top. A lid 2 is pivotally connected to the body. A plastic inner case 3 is mounted in the body 1.

The inner case 3 includes a plurality of partition plates 4 arranged side-by-side at a predetermined space intervals and uniformly inclined at a predetermined angles. Side plates 5, such as strips, are attached to opposite sides of the so arranged and inclined partition plates 4 at such a level that upper portions of the side plates and upper portions of the partition plates are somewhat exposed when the inner case 3 is mounted in the body 1. Two narrow base plates are attached in parallel with each other to undersides of the partition plates 4 to further enhance the structural steadiness of the inner case 3 and to support the photographs.

As shown in FIG. 1, each of the partition plates 4 has, at its upper side, a raised portion 4*a* which is protruded when the inner case is mounted in the body. Moreover, each of the partition plates 4 preferably has a generally inverted U-shape with two legs and the recessed portion between them in order to save a material of the plates. Preferably, the base plates 6 are attached to undersides of the legs of the plates 4, as shown in FIG. 1. The height of each said partition plate 4 at its portion without the raised portion 4*a* is slightly lower than that of a photograph to facilitate a search and taking out of the photograph when necessary.

In keeping the photographs in the box of the invention, they are inserted into spaces between the partition plates 4 and an identification label on which information, for example, a photographing date or place is inscribed and then attached on the raised portion 4*a* of the plates 4. Because the upper portions of the side plates 5 and the partition plates 4 are somewhat exposed in an assembled position wherein the inner case 3 is mounted into the body 1, a free play of the lid 2 in a closed condition is avoided without installing the separate inner box as in the prior art.

Further, the identification label attached on the raised portion 4*a* of the plate 4 replaces the index card in the prior art, eliminating use of separate parts. The inclination of the partition plate 4 provides a wide visual field when searching and removing the photograph and prevents the plate interfering with the lid 2 in its opening and closing operations.

It will be appreciated from the above description that the photograph keeping box according to the invention has the advantages of simplification of the manufacturing process and inexpensiveness of the cost due to the fact that the inner case 3 mounted in the body 1 has all functions of the inner box, the vinyl film bag and the index card of the box of the prior art. Further, this invention has an effect permitting very easy keeping and taking out of the photographs as compared with the prior art box.

Although only one embodiment of the invention has been disclosed and described, it is apparent that other embodiments and modification of the invention are possible without departing from the spirit and scope of the invention.

The invention claimed is:

1. A box for keeping photographs comprising a hexahedral body having an opened top, a lid pivotally connected to the body, and an inner case mounted in the body, said inner case comprising a plurality of partition plates arranged side by side at a predetermined angle, side plates attached to opposite sides of said partition plates to securely maintain the plates in their spaced and inclined conditions, and base plates attached in parallel with each other to undersides of said partition plates to further enhance a structural steadiness of said inner case and to support the photographs, each of said partition plates having at its upper side a raised portion.

2. A box for keeping photographs as claimed in claim 1, where said side plates are attached to opposite sides of the partition plates at such a level that upper portions of the side plates and partition plates are somewhat exposed when the inner case is mounted into the body.

3. A box for keeping photographs as claimed in claim 2, wherein each of said partition plates 4 has a generally inverted U-shape with two legs and a recessed portion between them, and the two base plates are attached to undersides of said legs of said partition plates.

* * * * *